US005522510A

United States Patent [19]

Luttrell et al.

[11] Patent Number: 5,522,510

[45] Date of Patent: Jun. 4, 1996

[54] APPARATUS FOR IMPROVED ASH AND SULFUR REJECTION

[75] Inventors: Gerald H. Luttrell; Roe-Hoan Yoon, both of Blacksburg, Va.

[73] Assignee: Virginia Tech Intellectual Properties, Inc., Blacksburg, Va.

[21] Appl. No.: 76,730

[22] Filed: Jun. 14, 1993

[51] Int. Cl.[6] ..... B03B 7/00; B03D 1/14

[52] U.S. Cl. ..... 209/170; 209/164; 209/168; 209/12.1; 209/18

[58] Field of Search ..... 209/12, 18, 164, 209/169, 166, 170, 451, 452, 453

[56] References Cited

U.S. PATENT DOCUMENTS

| | | |
|---|---|---|
| 1,656,271 | 1/1928 | Downs . |
| 2,376,703 | 5/1945 | Kuhlwein . |
| 2,693,878 | 11/1954 | Driessen . |
| 2,842,319 | 7/1958 | Reerink . |
| 2,932,395 | 4/1960 | Marot . |
| 2,970,689 | 2/1961 | Chang . |
| 3,579,442 | 5/1971 | Gerwig . |
| 3,794,162 | 2/1974 | Miller . |
| 3,908,912 | 9/1975 | Irons . |
| 4,175,035 | 11/1979 | Moyer . |
| 4,272,250 | 6/1981 | Burk . |
| 4,297,108 | 10/1981 | Horowitz . |
| 4,338,188 | 7/1982 | Guerre . |
| 4,460,376 | 7/1984 | Fahlstrom . |
| 4,537,599 | 8/1985 | Greenwald . |
| 4,598,873 | 7/1986 | Cleeman . |
| 4,775,106 | 10/1988 | Jha . |
| 4,802,976 | 2/1989 | Miller . |
| 4,915,706 | 4/1990 | Daley . |
| 4,966,608 | 10/1990 | Pawlak . |
| 4,981,582 | 1/1991 | Yoon et al. . |
| 5,167,798 | 12/1992 | Yoon et al. . |

FOREIGN PATENT DOCUMENTS

| | | |
|---|---|---|
| 2822431 | 12/1979 | Germany . |
| 2935576 | 3/1981 | Germany . |
| 2945535 | 5/1981 | Germany . |
| 2024250 | 1/1980 | United Kingdom . |

OTHER PUBLICATIONS

Forman, William E, "Current Status of Hydrocyclone Technology"—Mining Congress Journal, Dec. 1972.

Reynolds, George L., "Use of Cyclones in Modern Coal preparation Plants"—Mining Congress Journal, Jun. 1964.

Sabelski, Joseph, J. "Development of Standards of Performance for New Coal Preparation Plants"—Mining Congress Journal, Oct. 1972.

Emmett, R. C. Jr. "Preparation Plant Water Control"—Mining Congress Journal, Dec. 1969.

Taylor, Bill S. "Removal of Fine Pyrite by Hydrocyclones" Mining Congress; Journal, Nov. 1969.

Miller, F. G. "Flotation Combination with Hydrocyclones" Mining Congress Journal, Aug. 1969.

P. Tucker, et al., "Modelling the Multi–Gravity Separator"; *Les Techniques*, Dec. 1992, pp. 45–49.

F. F. Lins, et al., "Performance of a New Centrifuge . . . B. C., Canada"; *Minerals Engineering*, vol. 5, Nos. 10–12, pp. 1113–1121, 1992.

B. Knelson, "The Knelson Concentrator. Metamorphosis From Crude Beginning to . . . Acceptance"; *Minerals Engineering*, vol. 5, Nos. 10–12, pp. 1091–1097, 1992.

(List continued on next page.)

*Primary Examiner*—Thomas M. Lithgow

*Attorney, Agent, or Firm*—Witham, Curtis, Whitham, & McGinn

[57] ABSTRACT

An apparatus for separating impurities from coal, includes a device for removing a predetermined amount of ash-forming substances from the coal and a device for removing a predetermined amount of high specific gravity (e.g., pyrite) from the coal having been processed by the ash-forming substance removing device. The ash-forming substance removing device and the high specific gravity material removing device each possess characteristics that allow them to more efficiently reject different types of mineral impurities from coal.

9 Claims, 5 Drawing Sheets

OTHER PUBLICATIONS

Kenneth J. Miller, "Fine Grinding and Flotation to Desulfurize Coal"; *Proceedings*, Processing and Utilization of High Sulfur Coals, Oct. 1985, pp. 239–246.

A. W. Deurbrouck et al., "Wet Concentrating Tables"; *SME Mineral Processing Handbook*, Society of Mining Engineers, vol. 1, pp. 4–32—4–39, 1985.

F. B. Mitchell, "Flowing Film Concentrators"; *SME Mineral Processing Handbook*, Society of Mining Engineers, vol. 1, pp. 4–40—4–50, 1985.

| Test Series | Rejection of Ash (%) | Rejection of Sulfur (%) | Rejection of Pyrite (%) | Combustible Recovery (%) |
|---|---|---|---|---|
| MGS #1 | 25.9 | 36.7 | 60.1 | 90.3 |
| MGS #2 | 18.9 | 29.8 | 56.5 | 94.3 |
| Microcel #1 | 48.8 | 21.2 | 34.9 | 90.6 |
| Microcel #2 | 48.6 | 19.4 | 34.5 | 94.5 |

FIG.7

| Process Stream | Product Yield (%) | Product Ash (%) | Total Sulfur (%) | Pyritic Sulfur(%) | Combustible Recovery (%) |
|---|---|---|---|---|---|
| Microcel Product | 78.25 | 19.82 | 3.06 | 1.29 | 84.96 |
| Microcel Reject | 21.75 | 48.92 | 4.37 | 7.68 | 15.04 |
| Microcel Feed | 100.00 | 26.15 | 3.34 | 2.68 | 100.00 |
| MGS Product | 95.24 | 17.36 | 2.13 | 0.78 | 98.15 |
| MGS Reject | 4.76 | 68.85 | 21.72 | 11.62 | 1.85 |
| MGS Feed | 100.00 | 19.82 | 3.06 | 1.29 | 100.00 |
| Circuit Product | 74.53 | 17.36 | 2.13 | 0.78 | 83.39 |
| Circuit Reject | 25.47 | 51.83 | 6.91 | 8.26 | 16.61 |
| Circuit Feed | 100.00 | 26.15 | 3.34 | 2.68 | 100.00 |

FIG.8

APPARATUS FOR IMPROVED ASH AND SULFUR REJECTION

BACKGROUND OF THE INVENTION

1. Field of the Invention

The present invention generally relates to a method and apparatus for removing impurities from coal, and more particularly to a method and apparatus for separating ash and pyritic sulfur from coal and for achieving high levels of ash and pyritic sulfur rejection without fine grinding.

2. Description of the Related Art

Froth flotation, a surface-based process, has been widely employed in the coal industry for upgrading fine coal. Since coal is naturally hydrophobic, it can be separated from most types of mineral matter based on differences in surface wettability. Compared to other fine particle processing techniques, froth flotation offers many advantages including simple circuit layout, high unit capacity, good selectivity, and low equipment and maintenance costs.

Generally, coal is made into an aqueous slurry and then subjected to a physical beneficiation process such as froth flotation to remove impurities. However, while froth flotation is very selective for removing well-liberated mineral matter, it is less effective if the feed coal contains a large amount of composite particles (i.e., so-called "middlings") containing, for example, pyrite. This difficulty arises due to flotation recovery being a function of both particle size and particle composition. The optimum particle size for flotation is usually 100×200 mesh (Rastogi and Aplan, 1985. "Coal Flotation as a Rate Process," *Minerals and Metallurgical Processing,* Vol. 2, pp. 137–147). Therefore, a middlings particle of the optimum particle size can be recovered more readily than well-liberated coal particles that are outside the optimum range. The separation is further complicated when pyrite becomes hydrophobic due to superficial oxidation (Yoon et al., "On the Hydrophobicity of Coal Pyrite," *Proceedings,* 4th International Conference on Processing and Utilization of High Sulfur Coals, Idaho Falls, Id., August, 1991, pp. 241–253).

Recent studies indicate that surface-based processes such as froth flotation are inefficient in removing pyrite (e.g., a material having a relatively high specific gravity) from fine coal. This shortcoming is due to pyrite becoming hydrophobic under certain conditions and to the inability of flotation to effectively reject middlings particles.

The shortcomings of flotation with regard to pyrite rejection may be overcome by using a density-based separation technique which utilizes centrifugal force to increase the gravitational pull acting on the particles. Several such centrifugal separators, which are capable of treating flotation-size coal, have recently been introduced to the minerals processing environment. These include the Mozley Multi-Gravity Separator (Tucker, et al., "Modelling of the Multi-Gravity Separator," *Les Techniques,* December 1992, pp. 45–49), the Falcon Concentrator (Lins, et al., "Performance of a new Centrifuge (Falcon) in Concentrating a Gold Ore from Texada Island, B.C., Canada," *Minerals Engineering,* Vol. 5, 1992, pp. 1113–1121) and the Knelson Concentrator (Knelson, "The Knelson Concentrator: Metamorphosis from Crude Beginning to Sophisticated Worldwide Acceptance," *Minerals Engineering,* Vol. 5, 1992, pp. 1091–1097). These known separators are believed to be particularly useful for removing pyrite from coal because of the large differences in specific gravity.

However, ash-forming minerals (e.g., $SiO_2$, $Al_2O_3$, $Fe_2O_3$, etc.) are removed less efficiently by gravity separators because of their lower specific gravity. These separators are also incapable of handling ultrafine clay "slimes" that report with the clean coal by entrainment.

Thus, the inefficient rejection of both ash and pyritic sulfur is a common problem in industrial fine coal cleaning circuits and has hitherto not been addressed by the conventional systems.

SUMMARY OF THE INVENTION

It is therefore an object of the present invention to provide a system for removing both ash and pyritic sulfur more completely and reliably, and which combines surface- and density-based separation processes in a single circuit.

Flotation and centrifugal density-based separators, such as the multi-gravity separator (MGS), each possess characteristics that allow them to more efficiently reject different types of mineral impurities from coal. Thus, to overcome the deficiencies of the conventional systems which employ only one of these technologies, a new processing scheme has been developed which uses flotation in combination with a centrifugal separator, such as MGS, designed to grade flotation-size feeds. The flotation process primarily removes ash-forming minerals such as clay, while the centrifugal separator is effective in removing pyrite. Preliminary test data obtained with high-sulfur coals show that this processing scheme approximately doubles the pyritic sulfur rejection with little loss (<5%) in clean coal yield. A primary advantage of the inventive system is that high levels of ash and pyritic sulfur rejection can be achieved without fine grinding. Although liberation characteristics vary from seam to seam, many coals need to be pulverized to well below 400 mesh (38 μm), and some to below 10 μm, before good rejections of pyrite can be achieved (Miller, "Fine Grinding and Flotation to Desulferize Coal," *Proceedings,* Processing and Utilization of High Sulfur Coals, Columbus, Ohio, October 1985, pp. 239–246). The present invention is capable of achieving high rejections of pyrite and other mineral impurities at topsizes as coarse as 0.6 mm for certain coals.

BRIEF DESCRIPTION OF THE DRAWINGS

The foregoing and other objects, aspects and advantages will be better understood from the following detailed description of a preferred embodiment of the invention with reference to the drawings, in which:

FIG. 7 is a table illustrating results obtained with the flotation column cell and MGS technologies using an Illinois No. 5 seam coal;

FIG. 8 is a table illustrating results obtained by processing a 2.4×1.6 SG heavy media middlings product using the combined flotation column cell/MGS circuit according to the invention with a 65 mesh×O Pittsburgh No. 8 seam coal.

DETAILED DESCRIPTION OF A PREFERRED EMBODIMENT OF THE INVENTION

Figure 1:
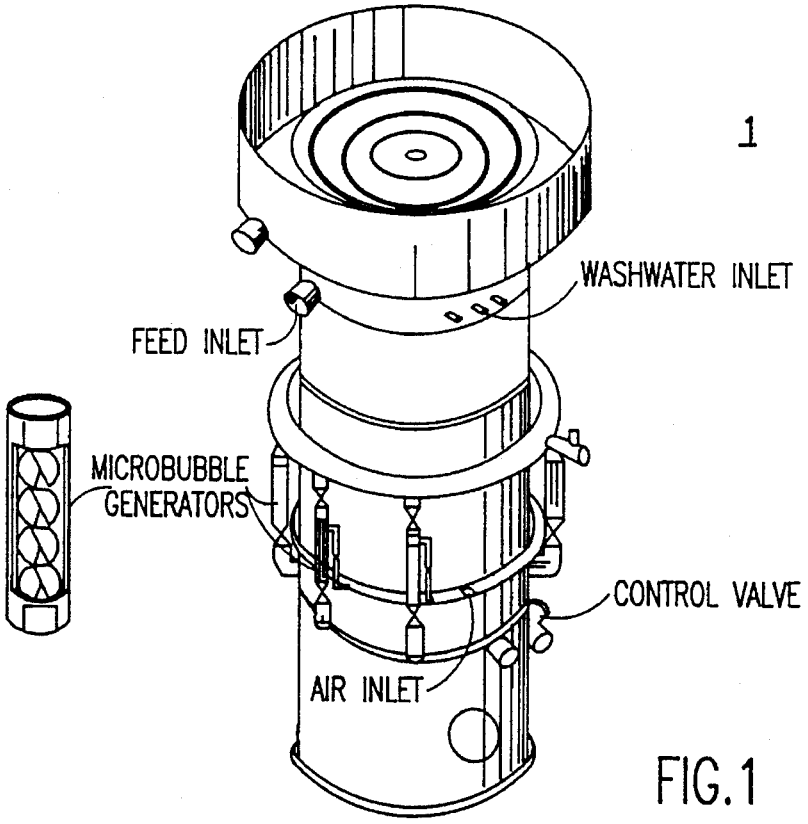
FIG. 1 is a schematic of an 8-ft. diameter flotation column cell (e.g., a Microcel)

Referring now to the drawings, and more particularly to FIG. 1, there is shown a flotation cell 1 which may have a single stage or multiple stage arrangement and which preferably is a Microcel, commercially available from ICF-Kaiser Engineers of Pittsburgh, Pa. and disclosed in U.S. Pat. Nos. 4,981,582 and 5,167,798, issued to Yoon et al. and incorporated herein by reference. The flotation cell (e.g., the Microcel) 1 generates and uses small air bubbles for flotation and as such employs a surface separation technique. Small air bubbles increase the rate of flotation and allow a higher throughput to be achieved at a given coal recovery rate (Yoon, et al., 1992. "The Application of Microcel Column Flotation to Fine Coal Cleaning," *Coal Preparation—An International Journal,* Vol. 10, 77–188). Additionally, the cell 1 (e.g., the Microcel) is equipped with a wash water system that minimizes the entrainment of ultrafine mineral matter (such as clay) into the froth product. Thus, the Microcel is capable of achieving better rejections of mineral matter than conventional flotation cells and thus is preferably used as the flotation cell.

FIG. 1 illustrates a schematic representation of a typical flotation column unit (e.g., the Microcel discussed above). The Microcel includes a housing having a plurality of inputs including a feed inlet, a washwater inlet, a frother addition inlet coupled to a slurry manifold, an air inlet, and a pump suction inlet. The Microcel also includes a plurality of outlets including a hydrophobic product outlet, a tailing outlet for output of a hydrophilic product and a discharge pump outlet. A wash water distributor and a microbubble generator are also included.

In the device, air bubbles in the range of 0.1–0.4 mm are generated by passing air and a portion of the flotation pulp through an in-line static mixer (i.e., microbubble generators, as shown in FIG. 1). The intense high-shear agitation provided by the in-line mixers generates air bubbles smaller (i.e., 0.1–0.4 mm) than other commercially available air sparging systems. The bubble generators are not subject to plugging or clogging and can be serviced without column shutdown because they are mounted externally and can be isolated by valves placed on each side of the respective generator.

Figure 2:
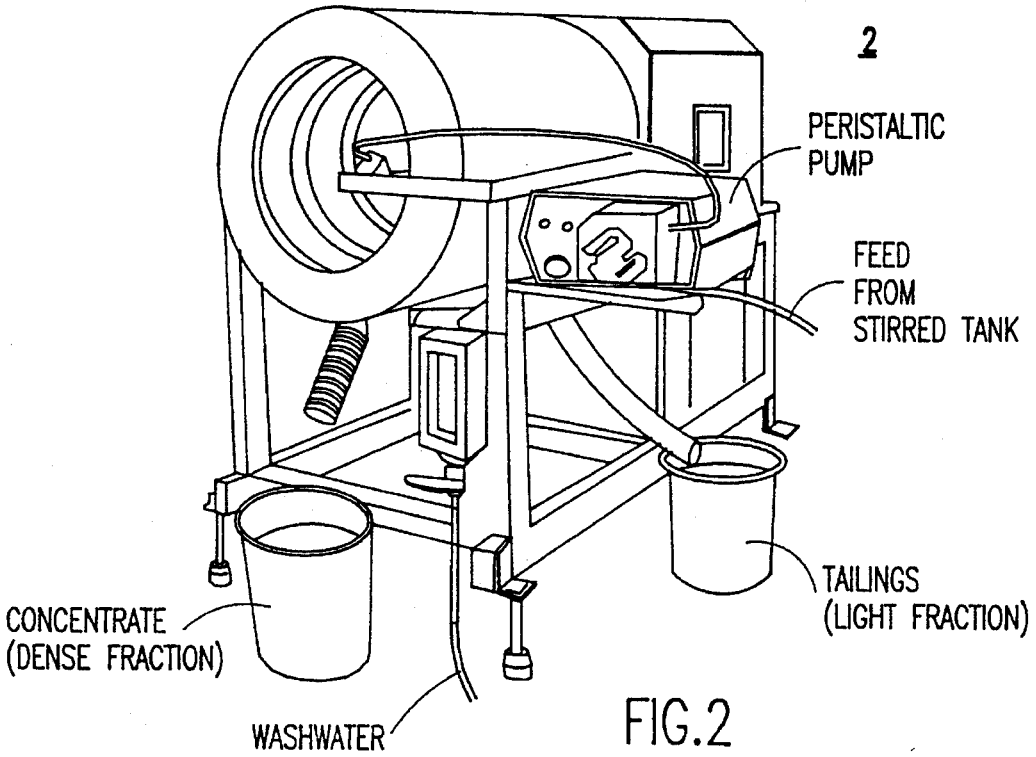
FIG. 2 is a schematic of a centrifugal density-based separator, such as a multi-gravity separator (MGS)

A separator 2, such as a centrifugal flowing-film separator or the like and more specifically such as a Multi-Gravity Separator (MGS), commercially available from Richard Mozley Limited, U.K. and distributed in North America by Carpco, Inc., of Jacksonville, Fla., is for selectively separating fine particles based on differences in density and as such employs a density separation technique. FIG. 2 illustrates a schematic of a MGS which includes a housing having a drum mounted thereon rotating at between 100–280 rpm, a peristaltic pump, inlets from the stirred tank, and outlets to a concentrate (i.e., dense fraction) supply means and a tailings (i.e., a light fraction) supply means. The housing of the MGS is adjustable to an angle between 0 and 9 degrees to the surface on which the MGS is positioned. A higher inclination increases the throughput capacity of the unit, but reduces the recovery of the heavy mineral (e.g., pyrite). An acceptable trade-off between capacity and recovery is established by the operator for each particulate system to be separated.

The operating principle of the MGS is similar to that of a conventional shaking table, i.e., separation is achieved by passing a flowing film of water and/or slurry over a stratified layer of particles such that larger and lower specific gravity particles are preferentially carried along by the flowing film which is collected separately, while higher specific gravity particles which remain near the surface of the table are carried along in a different direction by other physical means (see Deurbrouck et al., "Wet Concentrating Tables," *SME Mineral Processing Handbook,* Vol. 1, Society of Mining Engineers, New York, N.Y., 1985, pp. 4.32–4.33). For a shaking table, higher specific gravity particles are transported along the table surface to the reject outlet via a shaking mechanism, while scrapers are used to transport such particles from the inside surface of the MGS drum to the reject outlet.

However, by placing the table surface inside a rotating drum, it is possible to achieve many times the normal gravitational pull on the particles as they move across the table in a film flowing along the internal surface of the drum. The centrifugal field allows finer particles to be selectively separated than would be possible using conventional flowing-film separators because of the increased gravitational force that pins the higher density particles against the rotating drum.

Successful applications of the MGS technology include the concentration of cassiterite, chromite, wolframite, graphite, mixed sulfides and gold. For these applications, MGS can treat particles in the range of 1–1000 μm with high separation efficiencies. On the other hand, shaking tables are generally effective over a particle size range of 200–1,200 μm. The capacity of the MGS is also very high (i.e., a large volumetric flow rated can be maintained) since high density particles are held against the drum surface more strongly as a result of the centrifugal force generated thereby. A double-drum MGS unit has a capacity substantially equivalent to a dozen conventional shaking tables in terms of throughput when similar size particles are processed.

Generally, the surface-based separation technology as provided by the flotation column systems such as the Microcel is very effective for removing ash-forming minerals such as clay from fine coal streams. However, like any other surface-based process, sulfur rejection is relatively poor when the feed coal contains a large amount of coal-pyrite middlings or the pyrite is hydrophobic as a result of superficial oxidation. Further, while the MGS can process coal-pyrite middlings more effectively than flotation column cell technology, the separation efficiency thereof drops when the feed coal contains ultrafine clay slimes.

Therefore, in view of the problems of the flotation column cell and MGS individually, according to the present invention the MGS and Microcel technologies have been uniquely integrated and combined in a novel circuit which maximizes the rejection of both ash and pyritic sulfur, without the need for fine grinding.

Figure 3:
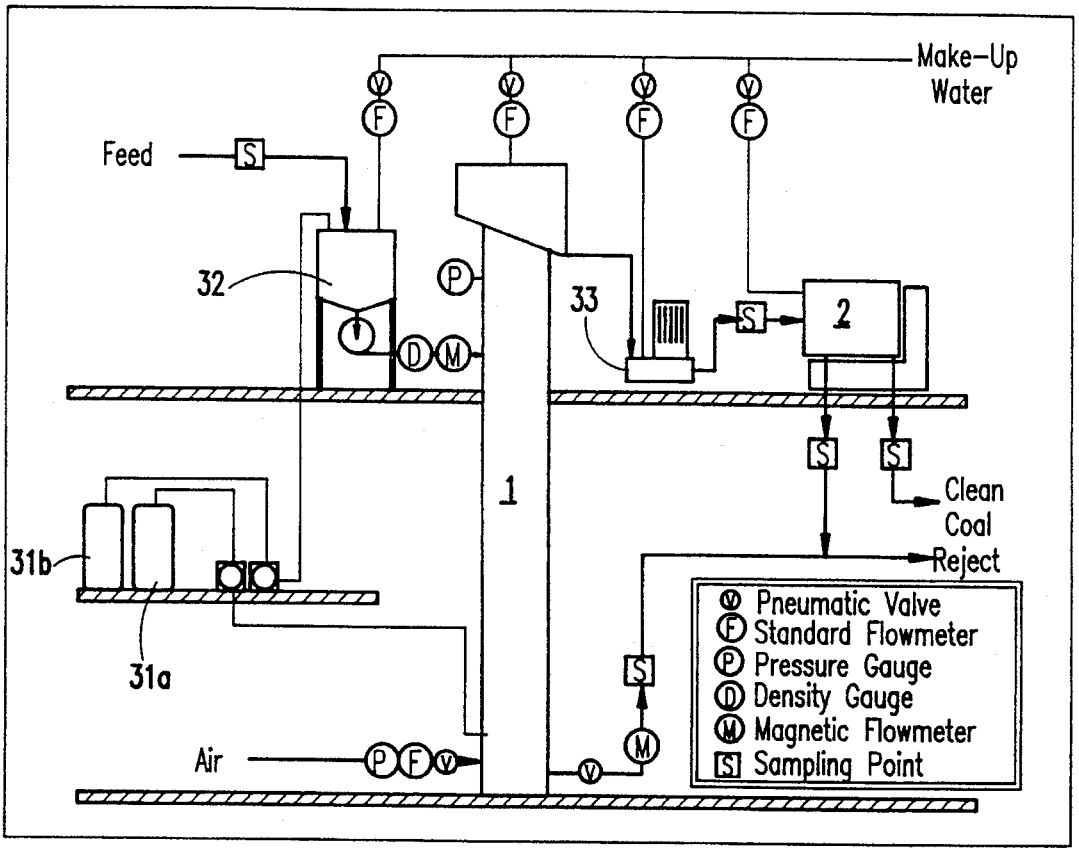
FIG. 3 illustrates a first embodiment of a coal cleaning circuit according to the invention having a combined flotation column/MGS coal cleaning circuit.

FIG. 3 illustrates the combined system and shows a process flow for the combined flotation column unit/MGS circuit, which is designed to process fine coal from a classifying cyclone or screening circuit. Generally, coal is mined and held at a storage facility. The coal is fed from the storage facility to a preparation plant where it is converted into a slurry to facilitate handling and processing. The naturally occurring fines, e.g., <0.6 mm particles, are removed by a suitable classification method such as screening and then enter the inventive circuit. Alternatively, all or various fractions of the feed coal, such as middlings fractions from conventional coarse coal separators, may be pulverized to an acceptable topsize (e.g., <0.6 mm) to improve liberation and also treated by the inventive circuit to enhance the rejection of impurities.

After conditioning with appropriate reagents such as hydrocarbon-based collectors (e.g., kerosene, diesel fuel, fuel oil, etc.) pH modifiers, dispersants, and/or depressants, the feed coal, which may be any type of coal, is treated by the flotation column cell, e.g., the Microcel, so that mineral matter is rejected with high efficiency.

Specifically, coal is provided along a feed line to a sump of a collector along with make-up water (via a valve and flowmeter arrangement). Desired reagents (e.g., hydrocarbon collector) in reagent tank 31*b* are metered by metering pumps to a sump 32 so as to condition the coal along with a predetermined amount of make-up water. Thereafter, the conditioned coal slurry is output from the sump to the flotation column cell at a predetermined rate established by the characteristics of the coal, cell size and operating conditions. Wash water is also provided to the flotation column cell through the wash water distributor located just above or within the froth bed. A portion of the flotation pulp is pumped from the bottom of the flotation column through a distribution ring which feeds the bubble generators. Frother is pumped from reagent tank 31*a* into the distribution ring.

Compressed air is injected into a high pressure side of each bubble generator via a separate air distribution ring and valving arrangement. The air-pulp-frother mixture flows through the bubble generators where the air is dispersed into small air bubbles before passing back into the lower portion of the flotation column cell. The froth product is permitted to overflow from the top of the flotation column into a collection launder, while the underflow of the flotation column cell is passed to a clarification circuit so that the process water can be recovered and recycled and particulate waste solids discarded.

Thereafter, the froth product from the column flotation cell is provided to a foam breaker 33, which is optional, along with make-up water. Alternatively, the froth product from the flotation column may be provided directly to the MGS. The foam breaker operates to destabilize the froth and to de-aerate the flotation concentrate. The output of the foam breaker is input to the MGS 2 unit along with any required make-up water, to reject pyrite that has not been removed by the flotation column cell. The MGS is a centrifugal density-based separator that selectively separates higher specific gravity particles (which report along with the flowing film to the concentrate outlet) from lower specific gravity particles (which are pinned to the drum surface and carried along by mechanical scrapers to the reject launder at the opposite end of the unit).

In the preferred operating regime, the MGS is operated such that the clean coal product is of an acceptable quality in terms of ash and sulfur content and recovered at an acceptable weight fraction (i.e., yield) relative to the feed coal. The concentrate from the MGS is passed to a suitable dewatering process where the solids are recovered as the final clean coal product and the process water is recycled. Additionally, the high-ash and high-sulfur reject streams from the column flotation cell and MGS are clarified so that the process water can be recycled and waste solids discarded. Sampling points and appropriate instrumentation are provided for the inlet and outlet streams to each unit operation so that the circuit performance are preferably ascertained and monitored during operation, as shown in FIG. 3.

The performance of the flotation column (e.g., the Microcel) and MGS technologies was compared by conducting laboratory tests using a 65 mesh×O coal sample from the Illinois No. 5 seam. The results of this comparison are summarized in FIG. 7. Test results were obtained under two different operating conditions with each separation technique. These particular tests were not conducted in a combined flotation column cell/MGS circuit. At a recovery of approximately 90%, the MGS achieved a higher overall rejection of pyrite (60% versus 35%), while the flotation column cell (e.g., the Microcel) achieved a higher ash rejection (49% versus 26%). Similar results were obtained in a second series of tests conducted at a slightly higher recovery of approximately 94%.

With the foregoing in mind, the present inventors have combined the flotation column cell and MGS technologies in a single circuit to maximize the rejections of both ash-forming minerals and pyrite and to optimize the advantages of both types of technologies.

To demonstrate the capabilities of the combined flotation column cell/MGS circuit, a test program was undertaken using a 65 mesh×O coal sample from the Pittsburgh No. 8 seam. The test sample assayed 8% ash, 2.6% total sulfur and 1.2% pyritic sulfur. The coal was subjected to flotation using a 14-inch diameter flotation column (e.g., a Microcel) and the froth was reprocessed using a 17-inch diameter MGS unit. For comparison, the same coal was subjected to a release analysis, the results of which represent the best possible flotation separation for a given feed and reagent scheme (Dell, 1964. "An Improved Release Analysis Procedure for Determining Coal Washability, "*Journal of the Institute of Fuel*", Vol. 37, pp. 149–150).

Figure 4:
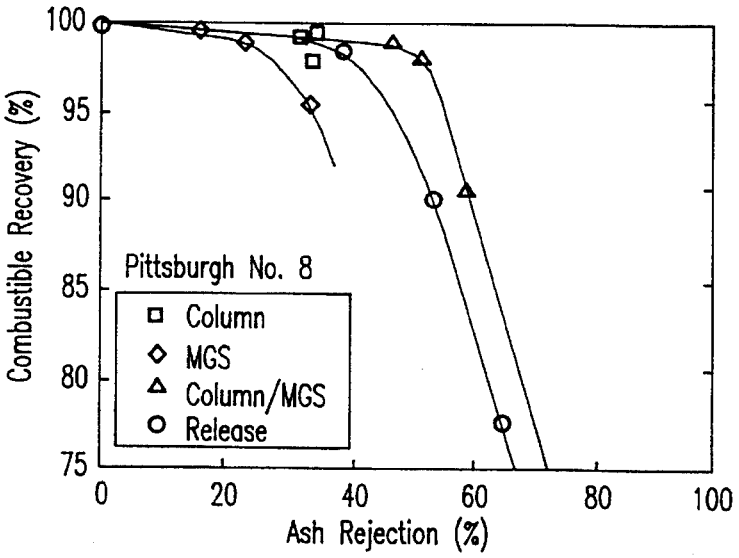
FIG. 4 is a graph illustrating combustible recovery versus ash rejection obtained using a flotation column cell, an MGS, a combined flotation column cell/MGS and release analysis with a 65 mesh×O Pittsburgh No. 8 seam coal.

As shown in FIG. 4, the ash rejections obtained using flotation column cell fell on the release analysis curve. This shows that the flotation column cell performed as well as could be expected for any flotation technology. The MGS results, on the other hand, fell significantly below the release analysis curve. This indicates that the MGS is not as efficient as the Microcel in removing ash-forming minerals. The best separation results, as shown in FIG. 4, were obtained by combining the two technologies.

As shown in FIG. 4, the ash rejection by the combined technologies was increased by approximately 10–25% over that obtained using either the flotation column cell or MGS alone. This improvement may be attributed to the ability of MGS to reject middlings particles that cannot be removed by the flotation column and the ability of the column to remove ash-forming minerals that cannot be removed by MGS.

Figure 5:
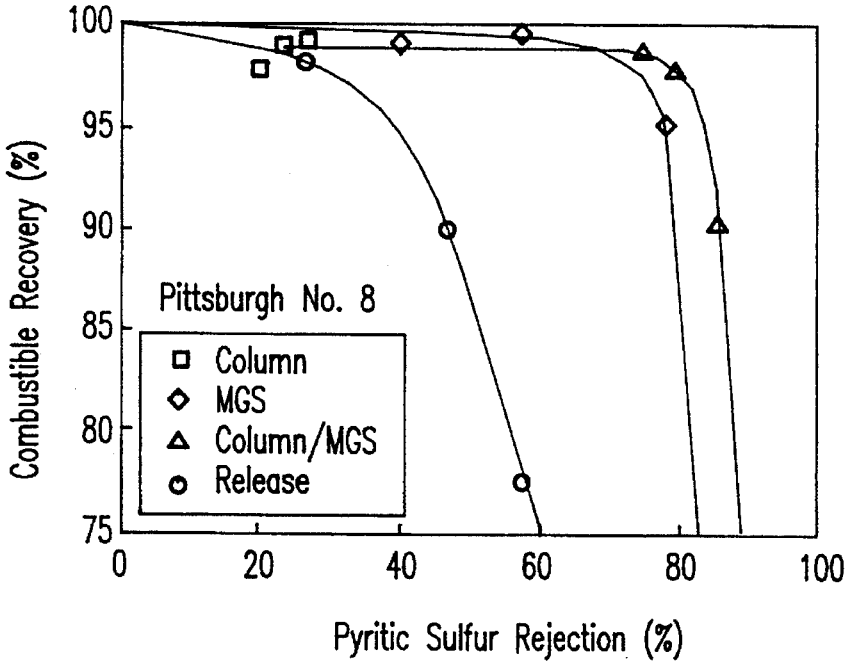
FIG. 5 is a graph illustrating combustible recovery versus pyritic sulfur rejection obtained using a flotation column cell, an MGS, a combined flotation column cell/MGS system and release analysis with a 65 mesh×O Pittsburgh No. 8 seam coal.

FIG. 5 shows the pyrite rejection obtained using the flotation column cell and MGS technologies. According to the release analysis results, column flotation should achieve approximately 45% pyritic sulfur rejection at a 90% recovery. In contrast, the pyritic sulfur rejection obtained using the MGS was far superior to the best possible flotation results. At a 90% recovery, a pyritic sulfur rejection of nearly 80% was obtained using the MGS alone. However, the highest level of pyritic sulfur rejection was achieved by recleaning the column froth product using the MGS. In this case, an 85% pyritic sulfur rejection was achieved at a combustible recovery of 90%.

An additional series of combined flotation column cell/MGS tests were performed using a middlings sample of Pittsburgh seam coal from northern West Virginia. The sample was a 1.4×1.6 SG float product from a heavy media circuit processing 2×¼ inch material. The sample assayed 26.2% ash, 3.34% total sulfur and 2.68% pyritic sulfur.

Prior to testing in the flotation column cell/MGS circuit, the sample was pulverized to a top size of 65 mesh to improve liberation. The results of these tests are summarized in FIG. 8. As shown, the reduction in ash content by flotation was relatively small (i.e., from 26.2% to 19.8%). This can be attributed to most of the clay minerals being removed by screening prior to processing of the 2×¼ inch coal by heavy media. In contrast, the pyritic sulfur content of the coal was reduced from 2.68% to 1.29% by flotation. A microscopic examination of the products indicated that most of the pyrite particles rejected by flotation were well-liberated and relatively free of coal inclusions. Reprocessing of the froth product by MGS further reduced the pyritic sulfur content to 0.78%. This improvement was achieved with little sacrifice in combustible recovery and demonstrates that the MGS was very selective.

Figure 6:
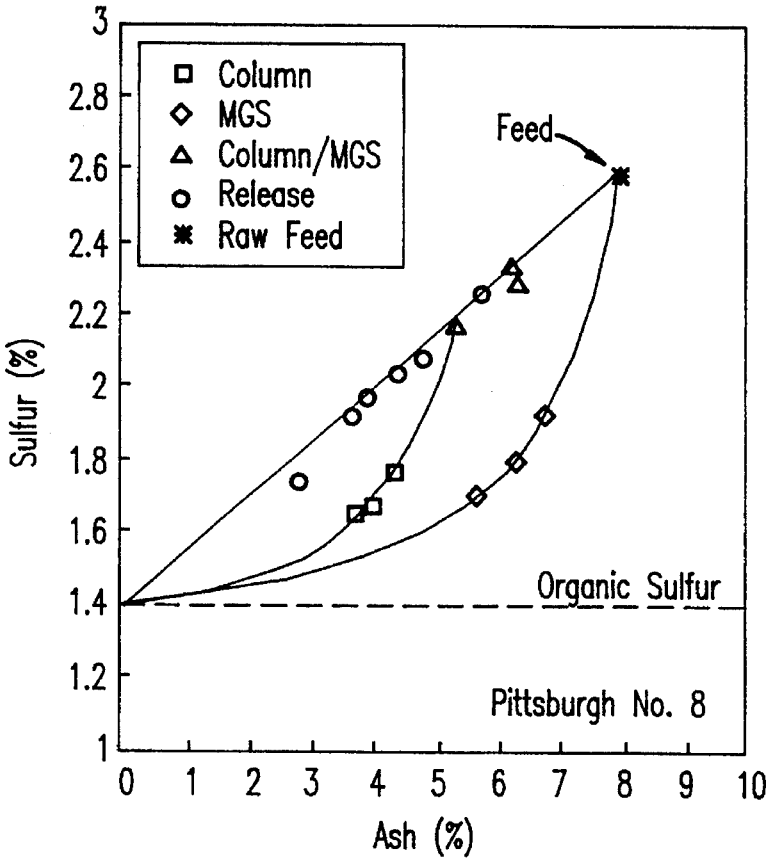
FIG. 6 is a graph illustrating total sulfur versus clean coal ash content obtained using a flotation column cell, an MGS, a combined flotation column cell/MGS system and release analysis with a 65 mesh×O Pittsburgh No. 8 seam coal.

The flotation column (e.g., Microcel) and MGS technologies each possess characteristics that allow them to reject different types of mineral impurities from coal. These differences are best illustrated by the data shown in FIG. 6, in which the data shown previously in FIGS. 4 and 5 have been replotted. A linear relationship exists between product sulfur and product ash for the data obtained using the flotation column cell. Thus, froth flotation is incapable of distinguishing pyrite from other mineral matter present in the feed coal. As shown, the sulfur content at zero-ash indicates the organic sulfur content of the coal. FIG. 6 also shows that the sulfur versus ash relationship is non-linear when the MGS is used alone and when both MGS and flotation column (e.g., Microcel) are used in the same circuit. This indicates that the MGS removes pyrite preferentially over other ash-forming minerals.

Thus, according to the invention, a new coal cleaning circuit, as described above, offers a methodology which can achieve high levels of pyritic sulfur rejection without fine grinding and which is capable of overcoming problems normally encountered with surface- and density-based coal cleaning processes. The circuit combines flotation (e.g., Microcel) with a centrifugal density-based separator (e.g., a Multi-Gravity Separator). Test data shows that the flotation column (e.g., a Microcel) is effective in rejecting well-liberated mineral matter, such as ultrafine clay slimes, from fine coal streams. On the other hand, the MGS is more efficient in removing composite particles containing a high specific gravity component. Test results obtained with high sulfur coals show that the combined flotation column/MGS circuit substantially improves the rejection of ash and sulfur from eastern U.S. coals. For the case of the Pittsburgh No. 8 coal, this processing scheme nearly doubles the rejection of pyritic sulfur with little loss (<5%) in clean coal yield.

A major advantage of the combined flotation column/MGS circuit is that it allows high levels of both ash and pyritic sulfur rejection without very fine grinding.

Figure 9:
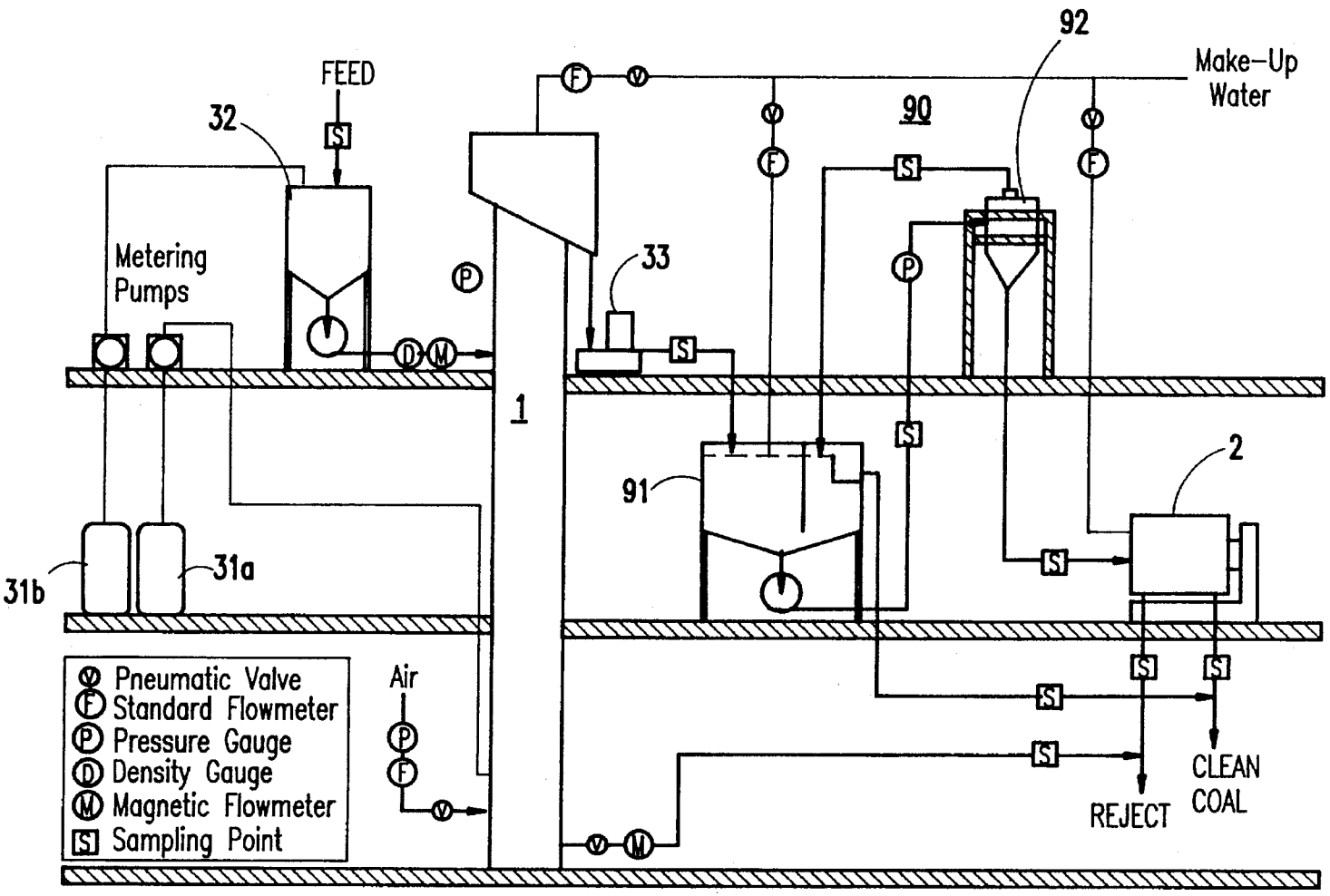
FIG. 9 illustrates a second embodiment of a coal cleaning circuit according to the invention and, more specifically, illustrates a combined flotation column/water-only cyclone/MGS coal cleaning circuit.

Another embodiment according to the invention, as shown in FIG. 9, includes a flotation column/MGS system and also a water-only cyclone (WOC) positioned between an output of the flotation column and an input of the MGS system. The inventors have found that the throughput of the MGS system is lower than that of the flotation column cell and thus the MGS throughput may limit the throughput of the entire system. Further, while it is envisioned that a plurality of MGS systems could be used in parallel and coupled to a single flotation column, the cost of the MGS systems is relatively high and practically such an alternative may be economically prohibitive in some cases. Hence, the present inventors designed the WOC for use with the flotation column/MGS system to increase throughput of the system and so as not to overburden the MGS system.

As shown in FIG. 9, this embodiment of the invention includes a three-stage processing circuit having a flotation column cell, a WOC 90 and a MGS arranged in series. The WOC is, for example, a centrifugal hydraulic classifier that separates particles based on differences in particle size and specific gravity.

In the first stage of processing, the feed coal slurry is conditioned in a sump with suitable reagents and is then passed through a flotation column cell where the hydrophobic constituents are separated from well-liberated impurities of mineral matter, such as clay and shale, which are hydrophilic. The flotation concentrate is passed to an optional foam breaker 33 where it is de-aerated, passed to a second holding sump 91, and diluted with make-up water to obtain a suitable solids content. Thereafter, the slurry is pumped to a second stage of processing in the WOC 90.

The WOC 90 includes a cyclone unit 92. Generally, larger and higher specific gravity particles report to the underflow at the apex of the cyclone, while smaller and lower specific gravity particles report to the overflow at the opposite end of the cyclone. In the preferred operating regime, the WOC system is operated such that the overflow product from the WOC is of an acceptable quality in terms of ash and pyritic sulfur. The WOC feed sump is partitioned such that a large portion of the clean coal from the WOC overflows the sump and is recovered as clean coal product, while a smaller portion of the clean coal from the WOC is allowed to mix with the diluted concentrate from the flotation column and recycle back to the WOC feed inlet. Such an arrangement provides flexibility in matching the capacity of the WOC system and column flotation cell with minimum risk of emptying the WOC feed sump should fluctuations in the process flow rates occur.

The underflow from the WOC, which in most cases contains coarse coal as well as pyrite, is passed to a third stage of processing in an MGS unit. The low specific gravity product from the MGS is combined with the overflow product from the WOC and, after passing through a suitable dewatering step, comprises the final clean coal product from the circuit. Generally, processing by the MGS is necessary to separate coarse coal from high specific gravity pyrite particles which report to the WOC underflow.

The reject streams from the column flotation cell and MGS unit are passed to a clarifier so that the process water can be recycled and particulate solids discarded. The inlet and outlet streams from each unit operation are equipped with sampling points and appropriate instrumentation so that circuit performance can be ascertained and monitored during operation. In the preferred embodiment, the unit operations in the circuit are arranged so that gravity flow can be exploited to minimize pumping requirements.

In the present embodiment, the WOC is designed to remove the cleanest fraction (i.e., the lowest specific gravity fraction) of the feed coal prior to feeding the MGS such that the amount of coal delivered to the MGS for processing is reduced. Thus, the WOC minimizes the load to the MGS unit so that the circuit can achieve a maximum throughput. Studies by the inventors have shown that by incorporating a WOC, the amount of coal directed to the MGS may be reduced by up to 40–50%, depending on the specific nature of the coal, thereby increasing the throughput of the system, and yet still effectively and efficiently separating ash and pyrite from the coal. Thus, as described above, the WOC, coupled between the flotation cell and the density-based separator, includes means for sensing a predetermined characteristic (e.g., particle size, specific gravity, etc.) of the coal having been output by the flotation column and for outputting to the density-based separator only coal having more than a predetermined amount of the predetermined characteristic.

With the second embodiment of the invention, the throughput of the system may be improved in an efficient manner by using the WOC to remove the cleanest fraction of the feed slurry from the system and thus to not overburden the MGS.

Many modifications of the first and second embodiments are envisioned by the inventors. For example, while the first and second embodiments discussed above describe processing fine coal by froth flotation followed by reprocessing by a centrifugal density-based separator, the order of processing may be reversed, as understood by one of ordinary skill in the art, and provide acceptable levels of performance. However, this alternative would require that a higher percentage of the feed coal be processed by the centrifugal density-based separator and thus is likely to have a higher unit processing cost. Further, with such a modification, due to throughput limitations of the density-based separator relative to the throughput of the froth flotation cell, parallel density-based separators may be advantageously employed to increase the throughput of the overall system.

Further, the ordinarily skilled artisan will recognize that while the exemplary higher specific gravity material described above is pyrite having a relatively high specific gravity as compared to coal, other materials or composites having a specific gravity greater than that of coal can be separated by the inventive system at the discretion and in accordance with requirements of the operator.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. An apparatus for separating solid impurities from coal, said apparatus comprising:

means for removing a predetermined amount of a first solid impurity comprising ash from said coal;

means for removing a predetermined amount of a second solid impurity comprising pyrite from said coal having been processed by said first solid impurity removing means, wherein said first and second solid impurity removing means are serially connected to one another, said first and second solid impurity removing means removing said first and second solid impurities based on first and second material properties, respectively, of said coal, said first and second material properties being different from one another, wherein said first solid impurity removing means comprises a flotation cell for removing ash as a tailing from a hydrophobic coal fraction, said flotation cell comprising a froth flotation-based separator, said second solid impurity removing means including a density-based enhanced gravity separator, said apparatus further comprising sump means for receiving the hydrophobic coal fraction from the flotation cell, said sump means including an overflow and an underflow, said second solid impurity having a predetermined characteristic, the underflow of said sump means being selectively connected to a water-only cyclone which has an overflow and an underflow, the cyclone overflow being connected back to said sump means and the cyclone underflow being connected to said second solid impurity removing means.

2. An apparatus according to claim 1, wherein said flotation cell comprises a flotation column cell.

3. An apparatus according to claim 1, further comprising means for feeding water to said first solid impurity removing means.

4. An apparatus according to claim 1, further comprising means for conditioning said coal to be input to said first solid impurity removing means.

5. An apparatus according to claim 4, further comprising means for feeding water to said first solid impurity removing means, and means for receiving said coal, said water and said coal conditioning means, and for outputting a predetermined amount of said coal having a predetermined amount of said water and having been conditioned by said coal conditioning means, to said first solid impurity removing means.

6. An apparatus according to claim 1, wherein said density-based separator comprises a centrifugal separator.

7. An apparatus according to claim 1, further comprising means for joining the overflow from the sump means to the coal fraction from the density-based separator to form a final coal product fraction.

8. An apparatus for separating solid impurities from coal, said apparatus comprising:

first means for exploiting differences in a surface wettability between a first solid impurity for removing a predetermined amount of said first solid impurity from said coal: and second means for exploiting differences in a density between a second solid impurity and said coal for removing a predetermined mount of said second solid impurity from said coal having beech processed directly before by said first solid impurity removing wherein both of said first and second solid impurity removing means treat a substantially same size of material, wherein said first solid impurity removing means comprises a flotation cell for removing ash-forming minerals as a tailings from a hydrophobic coal fraction, and wherein said second solid impurity removing means comprises a centrifugal density-based separator for removing pyrite as a tailings from a lower density coal fraction, said apparatus, further comprising sump means for receiving the hydrophobic coal fraction from the flotation cell, said sump means including an overflow and an underflow, wherein when said second solid impurity has a predetermined characteristic, the underflow of said sump means is selectively connected to a water-only cyclone which has an overflow and an underflow, the cyclone overflow being connected back to said sump means and the cyclone underflow being connected to said second solid impurity removing means.

9. An apparatus according to claim 8, further comprising means for joining the overflow from the sump means to the coal fraction from the density-based separator to form a final coal product fraction.

* * * * *